US007710038B2

(12) United States Patent
Patrician

(10) Patent No.: US 7,710,038 B2
(45) Date of Patent: May 4, 2010

(54) CERAMIC DISCHARGE VESSEL HAVING MOLYBDENUM ALLOY FEEDTHROUGH

(75) Inventor: Thomas J. Patrician, Monroeton, PA (US)

(73) Assignee: OSRAM Sylvania Inc., Danvers, MA (US)

( * ) Notice: Subject to any disclaimer, the term of this patent is extended or adjusted under 35 U.S.C. 154(b) by 349 days.

(21) Appl. No.: 11/962,606

(22) Filed: Dec. 21, 2007

(65) Prior Publication Data

US 2009/0160339 A1 Jun. 25, 2009

(51) Int. Cl.
*H01J 17/04* (2006.01)
*H01J 61/04* (2006.01)

(52) U.S. Cl. ..... 313/633; 313/574; 313/575; 313/608; 313/623; 313/624; 313/625; 313/631; 313/636

(58) Field of Classification Search ..... 313/574–575, 313/608, 623–625, 627–643, 631, 633, 636
See application file for complete search history.

(56) References Cited

U.S. PATENT DOCUMENTS

RE19,057 E * 1/1934 Hull ..... 315/107
2,159,806 A * 5/1939 Lenz et al. ..... 313/317
3,988,118 A * 10/1976 Grierson et al. ..... 75/248
4,300,189 A * 11/1981 Shanks ..... 362/267
4,334,628 A 6/1982 Buhrer et al.
4,366,410 A 12/1982 Buhrer
5,982,097 A * 11/1999 Mehrotra et al. ..... 313/631
6,774,547 B1 8/2004 Zaslavsky et al.

FOREIGN PATENT DOCUMENTS

EP 0136505 A 4/1985

OTHER PUBLICATIONS

Machine Translation of JP 2004-265779, cited by the Applicant.*
Abstract JP 2004-265779.

* cited by examiner

*Primary Examiner*—Sikha Roy
*Assistant Examiner*—Jose M Diaz
(74) *Attorney, Agent, or Firm*—Robert F. Clark

(57) ABSTRACT

A ceramic discharge vessel is described that is provided a feedthrough comprised of a molybdenum alloy containing at least 75 weight percent molybdenum and greater than 5 weight percent of nickel and at least one other alloying metal selected from copper and iron, wherein the weight ratio of the amount of nickel to the combined amount of copper and iron, Ni:(Fe,Cu), in the alloy is in the range of 1:1 to 9:1. The thermal expansion coefficient of the alloy is sufficiently matched to that of the ceramic so that the feedthrough may be sealed to the discharge vessel without causing cracking. Preferably, the feedthrough is directly sealed to the ceramic discharge vessel without the use of an intermediate frit material.

19 Claims, 4 Drawing Sheets

CERAMIC DISCHARGE VESSEL HAVING MOLYBDENUM ALLOY FEEDTHROUGH

BACKGROUND OF THE INVENTION

Ceramic discharge vessels are generally used for high-intensity discharge (HID) lamps which include high-pressure sodium (HPS), high-pressure mercury, and metal halide lamp types. The ceramic vessel must be translucent and capable of withstanding the high-temperature and high-pressure conditions present in an operating HID lamp. The preferred ceramic for forming discharge vessels for HID lamp applications is polycrystalline alumina (PCA), although other ceramics such as sapphire, yttrium aluminum garnet, aluminum nitride and aluminum oxynitride may also be used.

In conventional ceramic discharge vessels, conductive metallic feedthroughs are used to bring electrical energy into the discharge space. However, making the hermetic seal between the ceramic vessel and the metallic feedthrough can be troublesome because of the different properties of the materials, particularly with regard to the thermal expansion coefficients. In the case of polycrystalline alumina, the seal typically is made between the PCA ceramic and a niobium feedthrough since the thermal expansion of these materials is very similar. The niobium feedthrough is joined with at least a tungsten electrode which is used to form the point of attachment for the arc because it has a significantly higher melting point compared to niobium.

Niobium however as a feedthrough material has two significant disadvantages. The first disadvantage is that niobium cannot be exposed to air during lamp operation since it will oxidize and cause lamp failure. This necessitates that the discharge vessel be operated in either a vacuum or inert gas environment, which increases cost and the overall size of the lamp. The second disadvantage is that niobium reacts with most of the chemical fills used in metal halide lamps. Although the results of this reactivity are varied, these reactions inevitably lead to reduced lamp performance or life.

This concern has lead to the development of more complex electrode assemblies for metal halide applications. For example, one prior art electrode assembly for a ceramic metal halide lamp is comprised of four sections welded together: a niobium feedthrough for sealing to the ceramic arc tube; a molybdenum rod; a Mo-alumina cermet, and a tungsten electrode. Another described in U.S. Pat. No. 6,774,547 uses a multi-wire feedthrough having a ceramic core with a plurality of grooves along its outside length with the wires inserted in the grooves. The wires, either tungsten or molybdenum, are twisted together at least at one end of the feedthrough. The twisted wire may be used as the electrode inside the lamp or a separate electrode tip may be attached to the twisted wire bundle.

U.S. Pat. No. 4,366,410 describes closure members made from Mo—Ti and Mo—V alloys in place of niobium. The Mo—Ti and Mo—V alloys can be formulated to have coefficients of thermal expansion to match PCA. In addition, U.S. Pat. No. 4,334,628 further teaches that up to 5 weight percent of a sintering aid (Ni, Co or Cu) may be added to a Mo—Ti alloy to facilitate fabrication of the closure member by sintering. Unfortunately, both of these molybdenum alloys also have disadvantages. In particular, the Mo—Ti alloys adversely react with the metal halide chemical fills and the Mo—V alloys are very brittle and difficult to manufacture.

SUMMARY OF THE INVENTION

It is an object of the invention to obviate the disadvantages of the prior art.

It has been discovered that molybdenum heavy alloys (MoHA) have thermal expansion properties that sufficiently match the thermal expansion properties of polycrystalline alumina to be useful as a feedthrough material in the manufacture of ceramic discharge vessels. Moreover, the reactivity of MoHA to metal halide chemical fills should be similar to pure Mo since MoHA has two phases: one of pure Mo and the other a solid solution of Mo and the other alloying elements (called the matrix phase). The pure Mo phase usually makes up at least 80% of the volume of the microstructure, which means that only a fraction of the atoms exposed to lamp chemicals are from the alloying elements. The higher molybdenum concentration should impart a greater chemical resistance to the feedthrough. The alloying elements used in the MoHA feedthroughs are nickel in combination with at least one of iron and copper. For a fixed ratio of the alloying elements, e.g., Ni:Fe or Ni:Cu, the solid solution, matrix phase is a constant composition, viz. a saturated solution of Mo with the alloying elements. For example, in the case of MoHA containing Ni and Fe, the higher the ratio of Ni:Fe the greater the solubility of Mo in matrix.

Therefore, in accordance with one aspect of the invention, there is provided a feedthrough comprised of a molybdenum alloy containing at least 75 weight percent molybdenum and greater than 5 weight percent of nickel and at least one other alloying metal selected from copper and iron. In addition, the weight ratio of the amount of nickel to the combined amount of copper and iron, Ni:(Fe,Cu), in the alloy is in the range of 1:1 to 9:1. In a preferred embodiment, the molybdenum alloy contains from 85 to 93 weight percent molybdenum and has a Ni:(Fe,Cu) weight ratio of 7:3 to 9:1. Even more preferably, the molybdenum alloy contains 88 to 92 weight percent molybdenum and has a Ni:(Fe,Cu) weight ratio of 8:2 to 9:1.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

As used herein, all alloy compositions are given in weight percent (wt. %) unless otherwise indicated.

Figure 1:
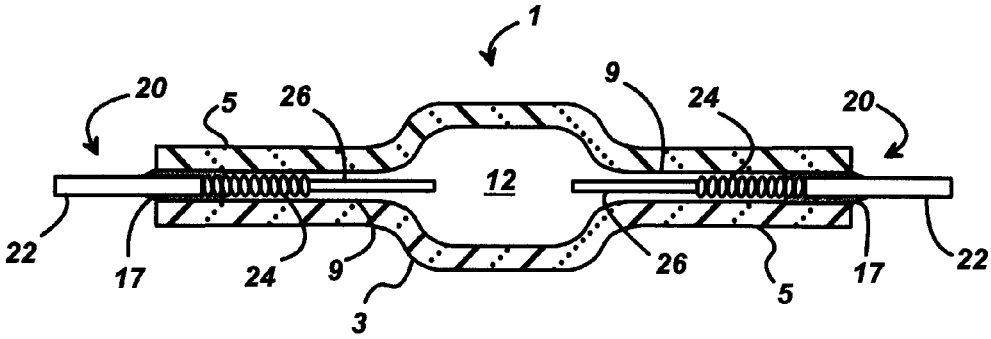
FIG. 1 is a cross-sectional illustration of a ceramic discharge vessel containing a molybdenum alloy feedthrough according to this invention.

Referring to FIG. 1, there is shown a cross-sectional illustration of a ceramic discharge vessel 1 for a metal halide lamp wherein the discharge vessel 1 has a translucent ceramic body 3 preferably comprised of polycrystalline alumina. The ceramic body 3 has opposed capillary tubes 5 extending outwardly from both sides. The capillaries 5 have a central bore 9 for receiving an electrode assembly 20. In this embodiment, the electrode assemblies 20 are constructed of tungsten electrode 26 and feedthrough 22 which is comprised of a molybdenum alloy according to this invention. A tungsten coil or other similar structure may be added to the end of the tungsten electrode 26 to provide a point of attachment for the arc discharge.

Discharge chamber 12 contains a metal halide fill material that may typically comprise mercury plus a mixture of metal halide salts, e.g., NaI, $CaI_2$, $DyI_3$, $HoI_3$, $TmI_3$, and TlI. The discharge chamber 12 will also contain a buffer gas, e.g., Xe or Ar. Frit material 17 creates a hermetic seal between capillary 5 and the feedthrough 22 of the electrode assembly 20. A preferred frit material is the halide-resistant $Dy_2O_3$—$Al_2O_3$—$SiO_2$ glass-ceramic system. In metal halide lamps, it is usually desirable to minimize the penetration of the frit material 17 into the capillary 5 to prevent an adverse reaction with the corrosive metal halide fill. For example, a molybdenum coil 24 may be wound around the shank of the tungsten electrode 26 to keep the metal halide salt condensate from contacting the frit material 17 during lamp operation.

The molybdenum alloy feedthrough of this invention may also be used in other feedthrough configurations. For example, it may be used in a multi-wire configuration such as in U.S. Pat. No. 6,774,547, or as a replacement for the niobium tube in conventional high-pressure sodium lamps. It may also be used in a frit-less seal configuration wherein the feedthrough is directly sealed to the ceramic without using an intermediate frit material.

The molybdenum alloy that forms the feedthrough contains Mo alloyed with Ni and at least one of Cu or Fe. The amount of Mo in the alloy is at least 75 wt. % and the combined weight of the other alloying elements, Ni, Cu and Fe, is greater than 5 wt. %, more preferably at least 7 wt. %, and even more preferably al least 8 wt. %. The weight ratio of the amount of Ni to the total amount of Cu and/or Fe should be in the range of 1:1 to 9:1, more preferably 7:3 to 9:1, and even more preferably 8:2 to 9:1. Although the alloy may contain small amounts of other elements that do not significantly affect the desired properties of the alloy, e.g., thermal expansion and chemical resistance, it is preferred that alloy consist of Mo, Ni, and Cu and/or Fe and only a minor level of metal contaminants, preferably less than 5000 ppm metal contaminants in total.

The feedthrough may be formed by conventional powder metallurgical techniques. Metal powders in the appropriate proportions are intimately mixed, pressed into compacts, solid-state sintered, and then liquid-phase sintered to full density. Wires, rods or other desired feedthrough shapes may then be made by rolling, drawing or other conventional metal forming methods for small reductions in area or cross sections. These types of alloys can undergo a reduction in area of about 30% without cracking. To obtain a greater amount of deformation, the worked material must be annealed or re-liquid-phase sintered.

EXAMPLES

Blends of pure Mo, Ni, Fe and Cu powders were made and then densified to about 65% of theoretical density by pressing at pressures of 30 ksi or higher. The pressed compacts were then solid-state sintered at 1440° C. for Mo:Ni:Fe alloys and 1125° C. for Mo:Ni:Cu alloys. After solid-state sintering the compacts were buried in alumina sand and liquid-phase sintered at 1500° C. for Mo:Ni:Fe alloys and 1440° C. for Mo:Ni:Cu alloys. Both sintering operations were conducted in a reducing or inert gas atmosphere to prevent oxidation. The liquid-phase-sintered densities for the alloys were 100% of theoretical density. The compositions of the alloys are given in Table 1.

TABLE 1

| Alloy Material | Density (g/cc) | Wt. % Mo | Wt. % Ni | Wt. % Fe | Wt. % Cu |
|---|---|---|---|---|---|
| 90% Mo—8.00% Ni—2.00% Fe | 10.02 | 90.00 | 8.00 | 2.00 | — |
| 80% Mo—16.00% Ni—4.00% Fe | 9.85 | 80.00 | 16.00 | 4.00 | — |
| 90% Mo—8.00% Ni—2.00% Cu | 10.05 | 90.00 | 8.00 | — | 2.00 |
| 80% Mo—16.00% Ni—4.00% Cu | 9.91 | 80.00 | 16.00 | — | 4.00 |

Figure 2:
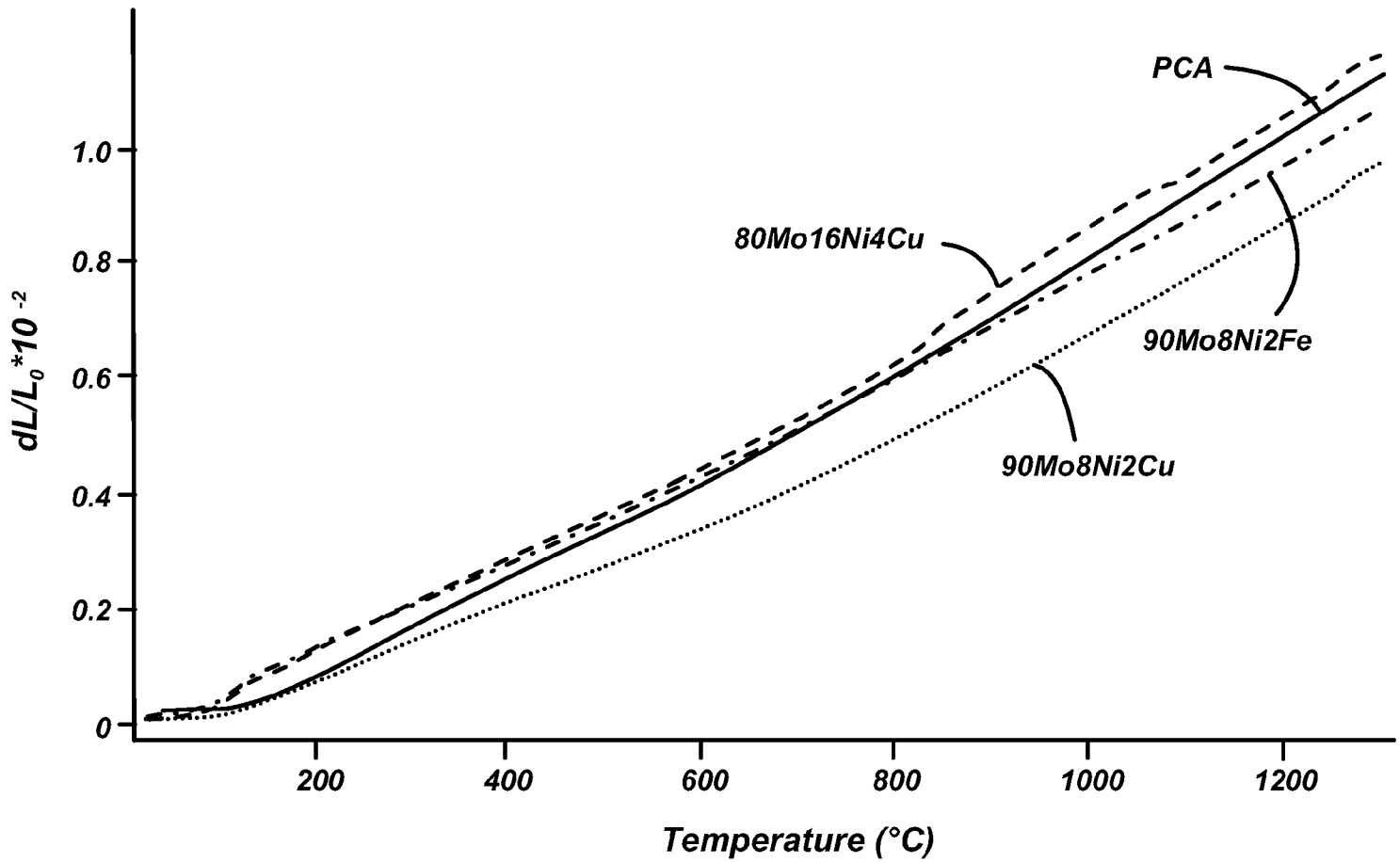
FIG. 2 is a graph of the thermal expansion of molybdenum alloys according to this invention compared with PCA.
Figure 3:
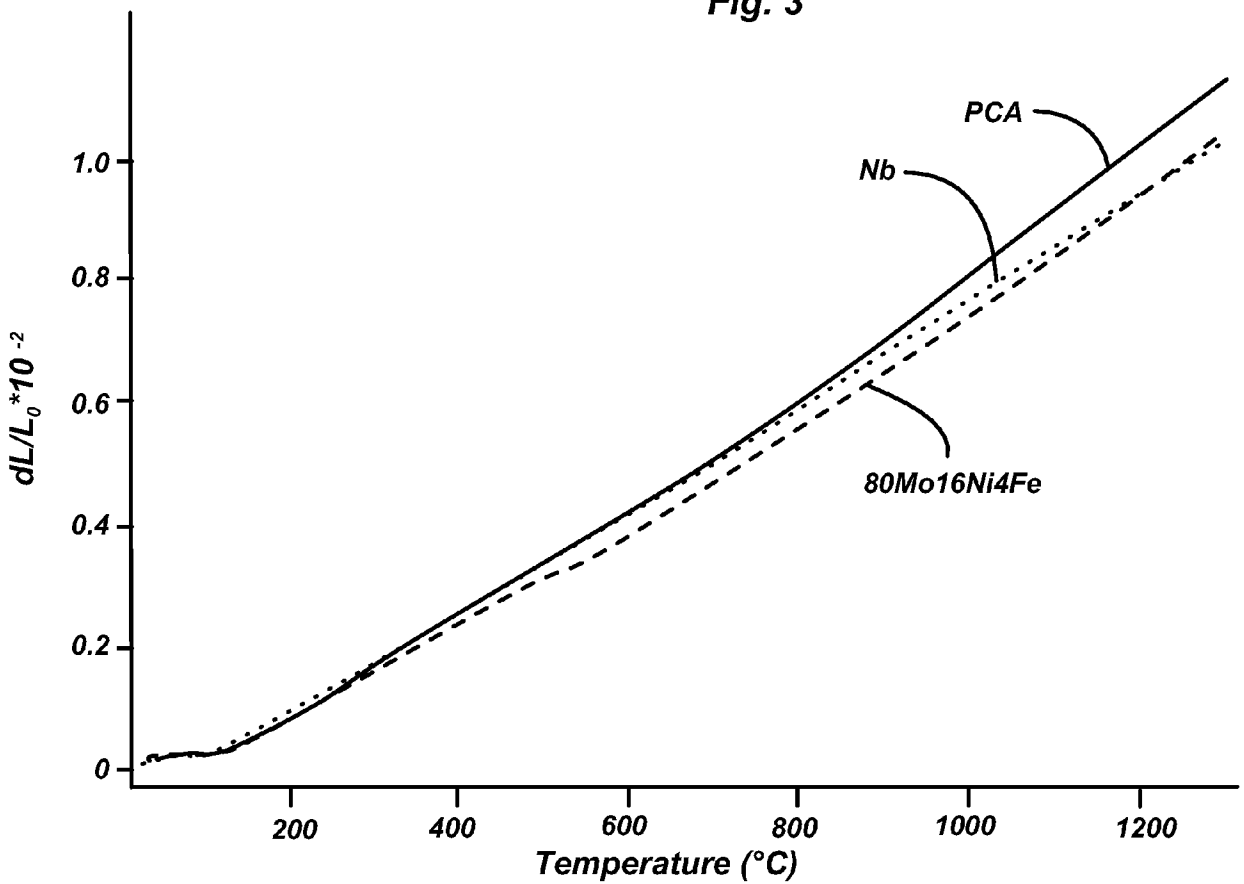
FIG. 3 is a graph of the thermal expansion of a preferred molybdenum alloy according to this invention compared with PCA and niobium.
Figure 4:
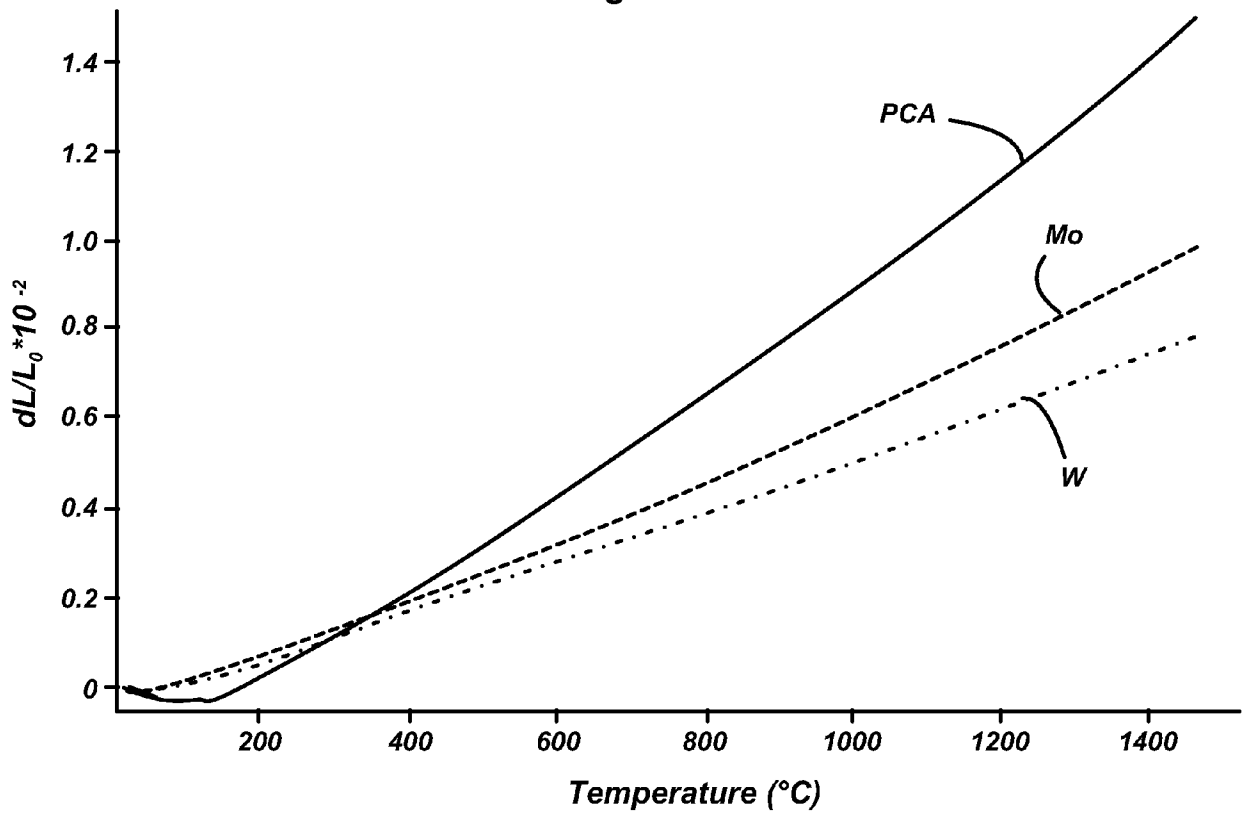
FIG. 4 is a graph of the thermal expansion of unalloyed molybdenum and tungsten compared with PCA.

Samples were then machined into cylinders and the thermal expansion properties measured in a dilatometer. FIGS. 2 and 3 compare the thermal expansion of the molybdenum alloys with the thermal expansion properties of PCA and niobium. From the two graphs it is clear that for a given temperature range different alloys more nearly match the coefficient of thermal expansion of PCA. The only alloy that is a poor match to PCA for all temperature ranges is 90% Mo-8% Ni-2% Cu. (For reference, FIG. 4 shows the thermal expansion of unalloyed molybdenum and tungsten compared with PCA.)

The 90% Mo-8% Ni-2% Fe alloy was tested for chemical resistance with a simulated metal halide environment and showed no significant reaction. Both Cu-containing alloys were found to have the same melting point and both Fe-containing alloys were found to have the same melting point. The Fe-containing alloys have a significantly higher melting point than the Cu-containing alloys as indicated by the liquid-phase sintering temperatures.

While there have been shown and described what are at present considered to be preferred embodiments of the invention, it will be apparent to those skilled in the art that various changes and modifications can be made herein without departing from the scope of the invention as defined by the appended claims.

I claim:

1. A ceramic discharge vessel comprising: a ceramic body and a feedthrough that is sealed to the ceramic body, the feedthrough being comprised of a molybdenum alloy containing at least 75 weight percent molybdenum and greater than 5 weight percent of nickel and at least one other metal selected from copper and iron, wherein a weight ratio of the amount of nickel to the combined amounts of iron and copper in the alloy is in a range of 1:1 to 9:1.

2. The ceramic discharge vessel of claim 1 wherein the molybdenum alloy contains 85 to 93 weight percent molybdenum and the weight ratio of the amount of nickel to the combined amounts of iron and copper is 7:3 to 9:1.

3. The ceramic discharge vessel of claim 1 wherein the molybdenum alloy contains 88 to 92 weight percent molybdenum and the weight ratio of the amount of nickel to the combined amounts of iron and copper is 8:2 to 9:1.

4. The ceramic discharge vessel of claim 1 wherein the combined amount of nickel, iron and copper in the alloy is at least 7 weight percent.

5. The ceramic discharge vessel of claim 1 wherein the combined amount of nickel, iron and copper in the alloy is at least 8 weight percent.

6. The ceramic discharge vessel of claim 1 wherein the ceramic body is comprised of polycrystalline alumina.

7. The ceramic discharge vessel of claim 1 wherein the feedthrough is sealed directly to the ceramic body without using a frit.

8. A ceramic discharge vessel comprising: a ceramic body and a feedthrough that is sealed to the ceramic body, the ceramic body being comprised of polycrystalline alumina, the feedthrough being comprised of a molybdenum alloy consisting of at least 75 weight percent molybdenum and greater than 5 weight percent of nickel and at least one other metal selected from copper and iron, wherein a weight ratio of the amount of nickel to the combined amounts of iron and copper in the alloy is in a range of 1:1 to 9:1.

9. The ceramic discharge vessel of claim 8 wherein the molybdenum alloy contains 85 to 93 weight percent molybdenum and the weight ratio of the amount of nickel to the combined amounts of iron and copper is 7:3 to 9:1.

10. The ceramic discharge vessel of claim 8 wherein the molybdenum alloy contains 88 to 92 weight percent molybdenum and the weight ratio of the amount of nickel to the combined amounts of iron and copper is 8:2 to 9:1.

11. The ceramic discharge vessel of claim 8 wherein the combined amount of nickel, iron and copper in the alloy is at least 7 weight percent.

12. The ceramic discharge vessel of claim 8 wherein the combined amount of nickel, iron and copper in the alloy is at least 8 weight percent.

13. The ceramic discharge vessel of claim 8 wherein the alloy consists of Mo, Ni and Fe.

14. The ceramic discharge vessel of claim 13 wherein the molybdenum alloy contains 85 to 93 weight percent molybdenum and the weight ratio of the amount of nickel to the amount of iron is 7:3 to 9:1.

15. The ceramic discharge vessel of claim 13 wherein the molybdenum alloy contains 88 to 92 weight percent molybdenum and the weight ratio of the amount of nickel to the amount of iron is 8:2 to 9:1.

16. The ceramic discharge vessel of claim 8 wherein the alloy consists of 90 weight percent Mo, 8 weight percent Ni, and 2 weight percent Fe.

17. The ceramic discharge vessel of claim 8 wherein the alloy consists of 90 weight percent Mo, 16 weight percent Ni, and 4 weight percent Fe.

18. The ceramic discharge vessel of claim 8 wherein the alloy consists of 90 weight percent Mo, 16 weight percent Ni, and 4 weight percent Cu.

19. The ceramic discharge vessel of claim 8 wherein the feedthrough is sealed directly to the ceramic body without using a frit.

* * * * *